US005437456A

United States Patent [19]

Schmidt et al.

[11] Patent Number: 5,437,456

[45] Date of Patent: * Aug. 1, 1995

[54] IRON GOLF CLUB HEAD WITH DUAL INTERSECTING RECESSES AND ASSOCIATED SLITS

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Apr. 12, 2011 has been disclaimed.

[21] Appl. No.: 225,775

[22] Filed: Apr. 11, 1994

Related U.S. Application Data

[63] Continuation of Ser. No. 999,250, Jan. 19, 1993, Pat. No. 5,301,946, which is a continuation-in-part of Ser. No. 921,857, Aug. 5, 1992, Pat. No. 5,282,625.

[51] Int. Cl.[6] ..... A63B 53/04

[52] U.S. Cl. ..... 273/169; 273/167 H; 273/167 F

[58] Field of Search ..... 273/77 A, 169, 167 A, 273/170, 167 F, 167 G, 167 H, 167 K, 167 J, 78

[56] References Cited

U.S. PATENT DOCUMENTS

| | | | |
|---|---|---|---|
| D. 228,355 | 9/1973 | Penna . | |
| D. 234,963 | 4/1975 | Kirata . | |
| D. 303,132 | 8/1989 | Muta . | |
| D. 321,920 | 11/1991 | Parente et al. . | |
| 1,854,548 | 4/1932 | Hunt . | |
| 1,993,928 | 3/1935 | Glover . | |
| 2,231,847 | 2/1941 | Dickson et al. . | |
| 3,068,011 | 12/1962 | Sano . | |
| 3,199,872 | 8/1965 | Taylor . | |
| 3,847,399 | 11/1974 | Raymont . | |
| 4,398,965 | 8/1983 | Campau . | |
| 4,420,156 | 12/1983 | Campau . | |
| 4,534,564 | 8/1985 | Yamada . | |
| 4,632,400 | 12/1986 | Boone . | |
| 4,740,345 | 4/1988 | Nagasaki et al. . | |
| 4,848,747 | 7/1989 | Fujimura et al. . | |
| 4,854,581 | 8/1989 | Long . | |
| 4,884,812 | 12/1989 | Nagasaki et al. . | |
| 4,913,435 | 4/1990 | Kobayashi . | |
| 4,928,972 | 5/1990 | Nakanishi et al. . | |
| 4,957,294 | 9/1990 | Long . | |
| 4,964,640 | 10/1990 | Nakanishi et al. . | |
| 4,986,541 | 1/1991 | Teramoto et al. . | |
| 4,995,609 | 2/1991 | Parente et al. . | |
| 5,046,733 | 9/1991 | Antonious | 273/167 F |
| 5,067,711 | 11/1992 | Parente et al. . | |
| 5,193,805 | 3/1993 | Solheim . | |
| 5,282,625 | 2/1994 | Schmidt et al. | 273/167 H |
| 5,301,946 | 4/1994 | Schmidt et al. | 273/167 H |
| 5,330,187 | 7/1994 | Schmidt et al. | 273/167 H |
| 5,344,150 | 9/1994 | Schmidt et al. | 273/167 H |

FOREIGN PATENT DOCUMENTS 371974 3/1932 United Kingdom .

OTHER PUBLICATIONS

"Some of Our Best Friends are Hookers and Pushers", Golf World, Jan. 1974, p. 45.

"The Ounce That Counts", Golf World, Jan. 24, 1975, pp. 46 & 47.

"Stroke-Savers", Golf Digest, Mar. 1988, pp. 82 & 83.

"FTD Iron by First Flight", Golf World, May 23, 1972, p. 10.

"The Wilson Staff Dynapower Iron", Time Magazine, Mar. 24, 1967, p. 1.

"T.P. Super Blade", Golf World, Jun. 13, 1972, p. 25.

*Primary Examiner*—Vincent Millin

*Assistant Examiner*—Steven B. Wong

*Attorney, Agent, or Firm*—William W. Haefliger

[57] ABSTRACT

A golf club head having a body defining a heel, toe, top wall, sole defining a bottom wall, and a front wall defining an upwardly and rearwardly inclined front face, and comprising the body defining a forwardly extending main recess located rearwardly of the front wall; and the body also defining an undercut recess located directly rearwardly of the front wall and extending outwardly from the main recess toward at least three of the following:

i) the top wall ii) the bottom wall iii) the toe iv) the heel;

the body having at least one elongated slit therein extending generally parallel to the front face and spaced rearwardly therefrom, the slit intersecting an outer surface defined by the body.

25 Claims, 8 Drawing Sheets

FIG. 18.
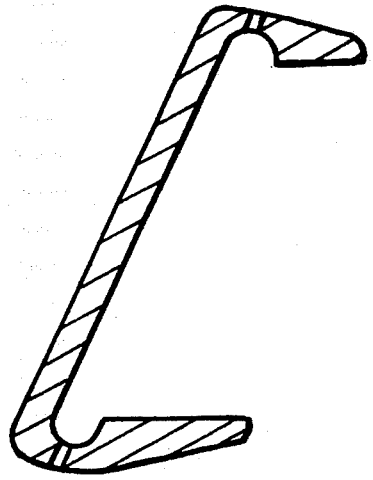
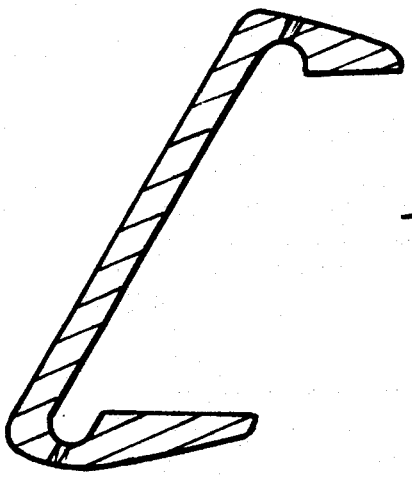
FIG. 19.
FIG. 20.
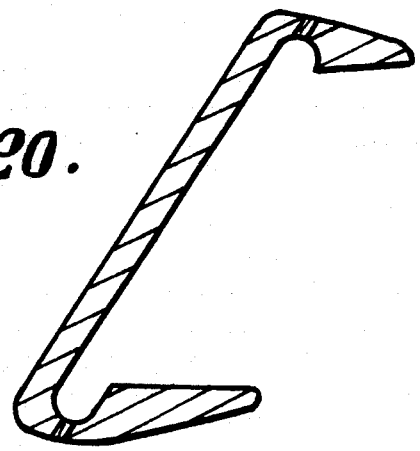

FIG. 21.
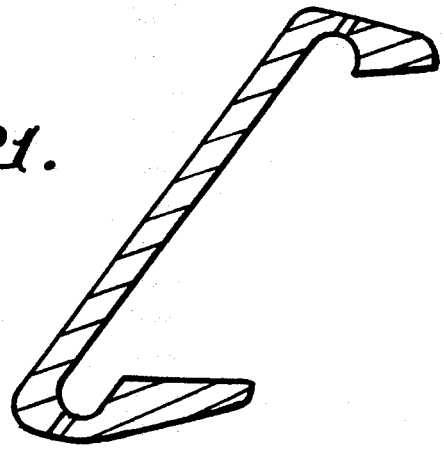
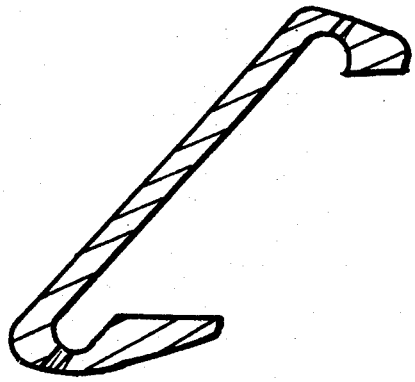
FIG. 22.
FIG. 23.
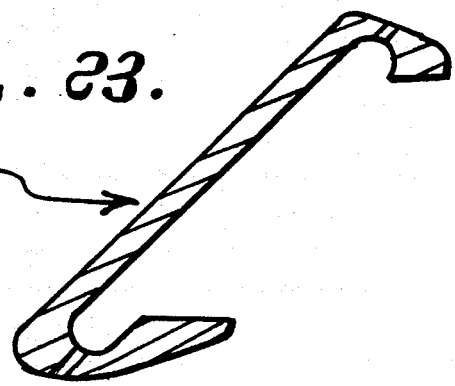

IRON GOLF CLUB HEAD WITH DUAL INTERSECTING RECESSES AND ASSOCIATED SLITS

This is a continuation of application Ser. No. 07/999,250, filed Jan. 19, 1993, now U.S. Pat. No. 5,301,746 which is a continuation-in-part of Ser. No. 921,857 filed Aug. 5, 1992 now U.S. Pat. No. 5,282,625.

BACKGROUND OF THE INVENTION

This invention relates generally to golf clubs, and more particularly to golf club irons of improved construction to achieve advantages, such as twist resistance, during impact with golf balls, and delayed momentum transfer to golf balls during stroking. In this regard, and in the past, irons evolved in design from flat back to hollow back structure, the present invention providing a further evolution in back structure to achieve virtual head enlargement effects.

Many efforts have been made to design iron heads to achieve higher energy availability for transfer to the golf ball when the ball is impacted by the head. However, no way was known, to our knowledge, to achieve delayed momentum transfer to the ball, over the very short time interval when the ball remains in contact with the head face, in the novel and unusual manner as achieved by the present invention; and no way was known to couple such delayed energy transfer with head twist resistance, in the manner to be described.

SUMMARY OF THE INVENTION

It is a major object of the invention to provide an improved iron head construction meeting the need for delayed momentum transfer to the ball during club stroking, and also to provide club head increased twist resistance. Basically, the invention as embodied in a head metallic body, is constructed to define two intersecting recesses rearwardly of the head front wall, and bounded by head metallic extents projecting rearwardly proximate peripheral regions of the head face defining front wall. For example, the head may include:

a) a body defining a forwardly extending main recess located rearwardly of the front wall, b) and the body also defining an undercut recess located directly rearwardly of the front wall and extending outwardly from the main recess toward at least two and preferably three of the following:
   i) the top wall
   ii) the bottom wall
   iii) the toe
   iv) the heel, c) the body having at least one elongated slit therein extending generally parallel to the front face and spaced rearwardly therefrom, the slit intersecting an outer surface defined by the body. Typically, at least two such slits are provided to intersect:
   v) top wall
   vii) the bottom wall
   viii) an outer surface defined by the toe.

As will be seen, the undercut recess may extend outwardly from its intersection with the main recess toward all of the top and bottom walls, and the toe and heel, whereby the undercut recess may then bound the main recess. This construction facilitates slightly delayed forward transfer of momentum of the body metal rearwardly of the undercut recess, to the front wall and front face, via peripheral extents of the head. Such peripheral extents are localized due to the slits, as defined. Typically, the metal of the head has reduced thickness directly rearwardly of the front wall periphery, due to the provision of the undercut recess, as referred to. This also enables reallocation of some metal to project rearwardly from the looping recess, enhancing head peripheral weighting for anti-twist effect.

Another objective is to provide an undercut recess, as referred to, which extends in a loop that lies generally parallel to the inclined front face of the iron, the slits, as referred to, extending toward that loop, the inclination of which varies with the number of the iron, designating different front face inclinations, as for example 1 to 9 irons and wedges.

Yet another object is to provide such slits to terminate endwise in spaced relation from head corners defined by merging of the top wall and toe, the bottom wall and toe, and the bottom wall and heel.

A further object is to provide the head with a rearward projection with upward thickening between the bottom wall and the main recess, and rearwardly of the undercut recess that extends toward the bottom wall; and the head may also have a rearward projection with downward thickening between the top wall and the main recess, and rearwardly of the undercut recess that extends toward the top wall.

Yet another object is to provide a set of irons, each iron incorporating the dual intersecting recesses, and slits, as referred to, and the rearward projections extending generally horizontally irrespective of the angles of the front faces of the irons in the set.

These and other objects and advantages of the invention, as well as the details of illustrative embodiments, will be more fully understood from the following specification and drawings, in which:

DRAWING DESCRIPTION

FIGS. 15–22 are sections like FIG. 8 but showing a sequence of head cross sections from a #2 iron to a #9 iron; and FIG. 23 is a section like FIG. 22 but showing a pitching wedge cross section.

DETAILED DESCRIPTION

Figure 1:
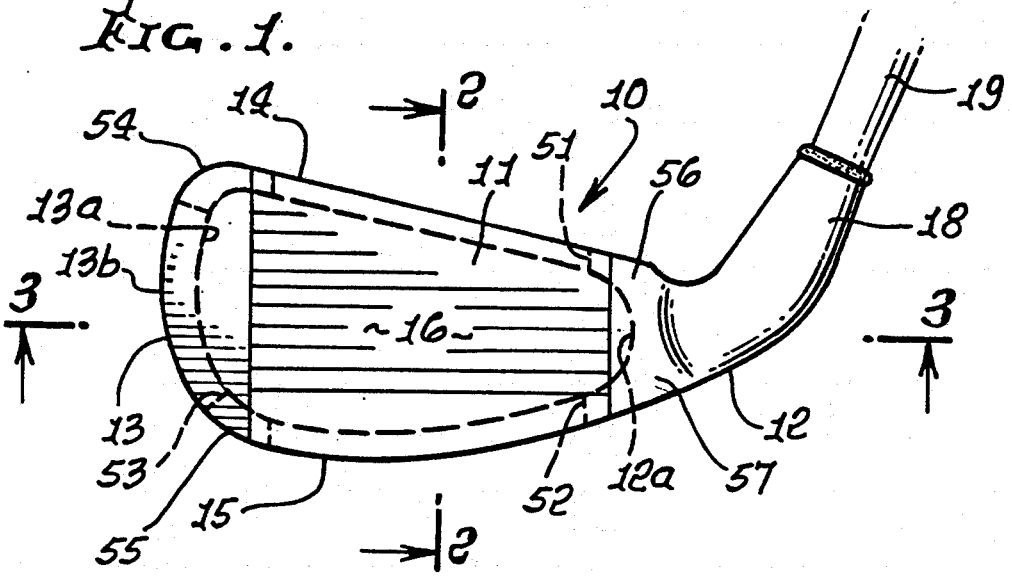
FIG. 1 is a frontal elevation of a #1 iron of a golf club set incorporating the invention.

Referring first to FIG. 1, the illustrated golf club head 10, in the form of a #1 iron of a set, has a body 11 defining a heel 12, toe 13, top wall 14, and sole 15. The body also defines an upwardly and rearwardly inclined front face 16 at the frontal side of an associated front wall 17. A hosel is shown at 18 and integrally joins the body; and a shaft 19 extends into and through the hosel as shown, and is anchored therein in a suitable manner. The head and hosel may consist of a one-piece, metallic, steel casting, other metals and alloys being usable.

The body defines two intersecting recesses related to rearwardly elongated body projections, typically extending rearwardly, as will be described, irrespective of the head front face angularity. The two recesses include a forwardly and rearwardly extending main recess 21, and an undercut recess 22 located directly rearwardly of the front wall and extending outwardly from the forwardmost extent of the main recess 21, toward at least three of the following:

a top wall 14 ii) a bottom wall or sole 15 iii) the toe region 13 iv) the heel region 12.

Typically, the undercut recess portions 14*a* and 15*a*, associated with walls 14 and 15, are elongated directionally between the toe and heel, over the major length of the head, thereby enhancing the benefits of the invention. These benefits include metal redistribution toward the upper and lower peripheries of the head, and projecting rearwardly at 24 and 25, for enhancing anti-twist of the head during stroking and ball impact. Such metal rearwardly redistribution, i.e., lengthening in a rearwardly and functionally outwardly (enlarging effect) direction, as at 24 and 25, rearwardly of undercuts 14*a* and 15*a*, is believed to achieve somewhat delayed momentum transfer from the metal portions 24 and 25, to the front wall and front face 16, thereby maintaining a greater time interval of front face contact with the ball during stroking, for better ball control.

This effect is further enhanced by the provision of at least one elongated slit extending generally parallel to the front face 16 and spaced rearwardly from that face 16.

Figure 2:
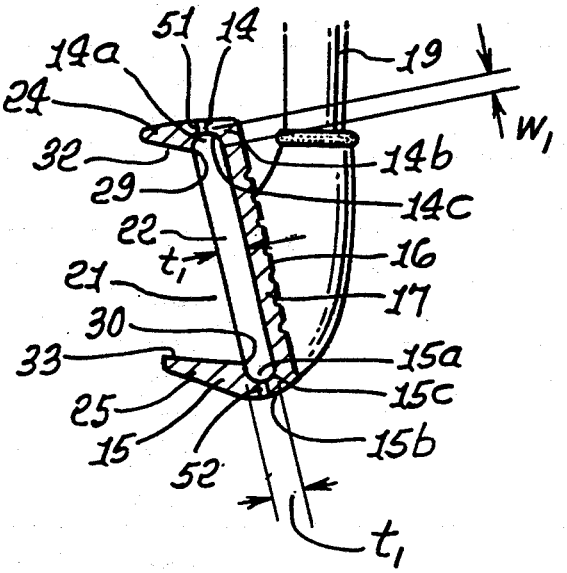
FIG. 2 is a section taken on lines 2—2 of FIG. 1.
Figure 3:
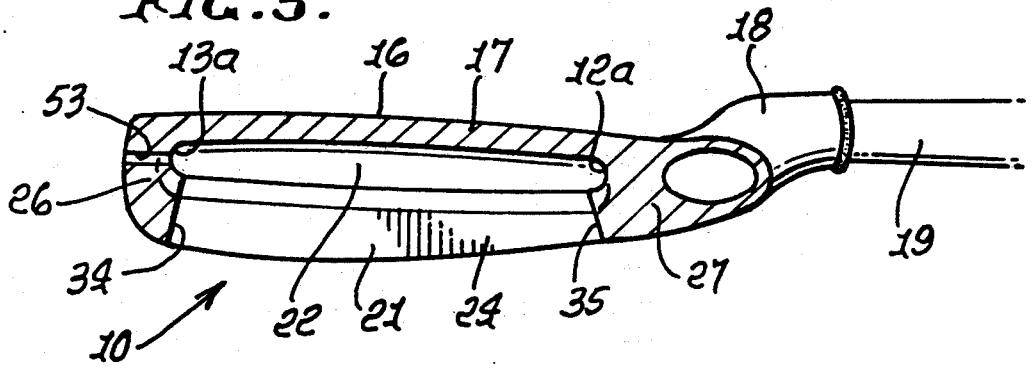
FIG. 3 is a horizontal section on lines 3—3 of FIG. 1.

In FIGS. 1-3, there are three such slits—51, 52 and 53—slit 51 cut in or intersecting the top wall 14 and also intersecting undercut recess extent 14*a*; slit 51 being narrow and elongated in a direction between the toe and heel; slit 52 cut in or intersecting the bottom wall 15 and also intersecting undercut recess extent 15*a*, slit 52 also being narrow and elongated in a direction between the toe and heel; and slit 53 cut in the toe 13 to intersect toe outer surface 13*b*, as well as undercut recess extent 13*a*; slit 53 being narrow and arcuately elongated in a direction between the curved corners 54 and 55 of the head. Corner 54 is at the merging of the top wall 14 with the toe; and corner 55 is at the merging of the bottom wall 15 and the toe 13. Note that slits 51-53 also extend generally toward the main recess 21 intersecting undercut recess 22. Slits 51-53 may be spaced rearwardly from undercut recess 22, if desired.

Note that such momentum transfer, visualized in the form of forward waves, is required to pass around and through the reduced thickness forward portions 14*b* and 15*b* of the rearwardly projecting portions 24 and 25, and at the corners 54 and 55, as well as at regions 56 and 57 near the heel, due to the interruption provided by the slits 51-53 enhancing such delay. Such delay of wave travel through such restricted, narrowed regions 14*b* and 15*b*, and at 54-57, is facilitated by the outwardly concave curvature at 14*c* and 15*c*, or other similar thickness narrowing shape, bounding the outermost extents of the undercuts 14*a* and 15*a*. Enhanced performance is thereby achieved in terms of better ball stroking and directional control, through delayed momentum transfer to the struck ball.

The undercut recess portions 12*a* and 13*a*, associated with the heel and toe, and associated metal redistribution rearwardly and functionally outwardly (i.e., enlarging effect) from those undercuts, at corners 54-57, contribute to and add to the same effects as described above for the undercut recess portions 14*a* and 15*a* at those corners. The undercut recess projects outwardly to an extent $w_1$ (which may vary, as shown); however, the front-to-rear thickness $t_1$ of the undercut recess is approximately as follows:

$$0.5t_1 < w_1 < 1.5t_1$$

The radius of the circular curvatures at 14*c* and 15*c* are typically between 0.150 and 0.160 inches for #1 through #7 irons; between 0.210 and 0.230 for #8 and #9 irons; and between 0.300 and 0.320 for a pitching wedge; however, these dimensions can vary.

Note in this regard the rearward projections 26 and 27 in FIG. 3, extending rearwardly from the undercuts 12*a* and 13*a*. Such rearward projections 24 and 25, 26 and 27, are rearwardly elongated in relation to their thickness dimensions showing that metal has been redistributed to those projections to enhance the effects described and without increasing the overall vertical dimension of the head.

Note also that the dimension of the recess 21, between internal corners 29 and 30, is at least about three times greater than the depth dimension of each of the undercut recess portions 14*a* and 15*a*, in an outward direction from those corners. The inner sides 32 and 33 of the projections 24 and 25 are substantially flat in a forward to rearward direction; however, they define a loop in combination with the corresponding inner and curved sides 34 and 35 of the projections 26 and 27, that loop subtending the major aerial extent of the front face, including a "sweet spot". Correspondingly, all undercut sections 14*a* and 15*a*, 26*a* and 27*a*, also define, preferably, a loop.

Figure 13:
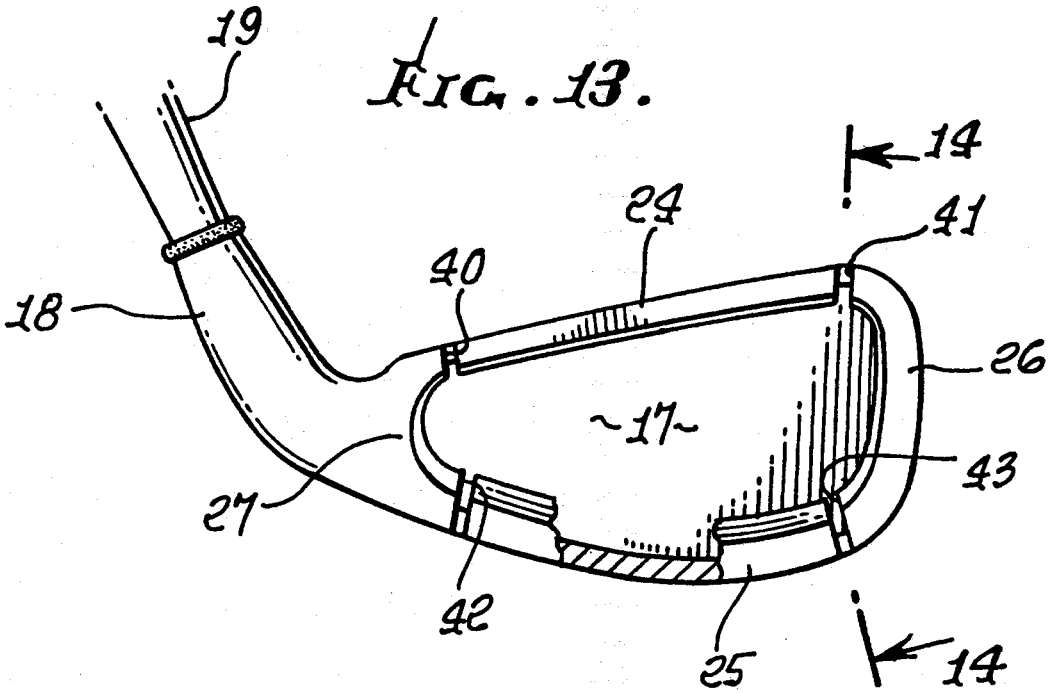
FIG. 13 is a rear view of a head, like that of FIGS. 1–3, but showing the slits extending outwardly from the undercut recess at different positions along the looping length of that recess.
Figure 14:
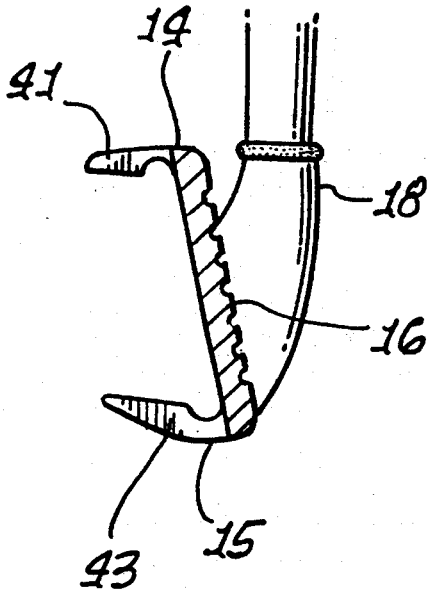
FIG. 14 is a section taken on lines 14—14 of FIG. 13.

FIG. 13 shows that slots may be provided, as at 40-43, proximate corners of the loop defined by the rearward projections 24-27 to decouple or reduce the stiffening effect of joining the rearward extending portions 24-27 at the loop corners. This allows the momentum transfer from each of such portions to proceed forwardly with further delayed action, as referred to without being affected by the momentum transfer associated with the other portions, or attenuated by the effects of such other portions. The slots 40-43 may intersect the slits 51, 52 and 53 previously described.

Figure 4:
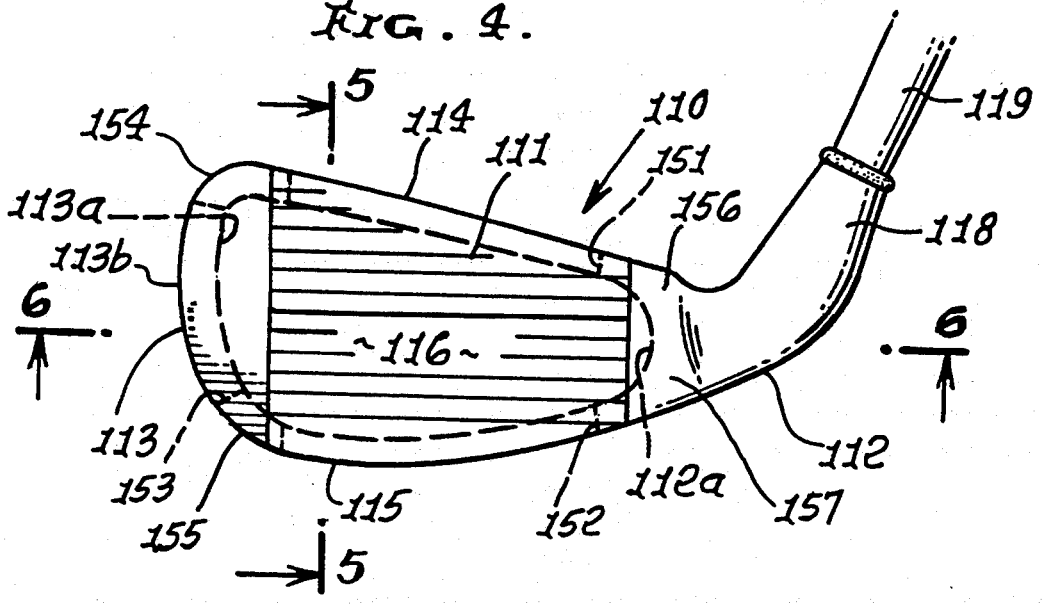
FIG. 4 is a view like FIG. 1 but showing a #6 iron incorporating the invention.
Figure 5:
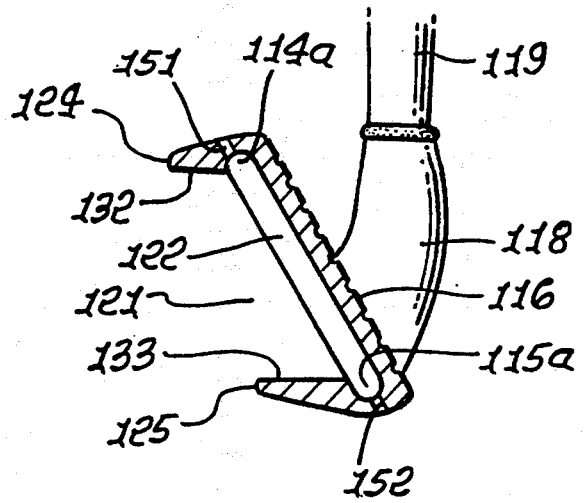
FIG. 5 is a section taken on lines 5—5 of FIG. 1.
Figure 6:
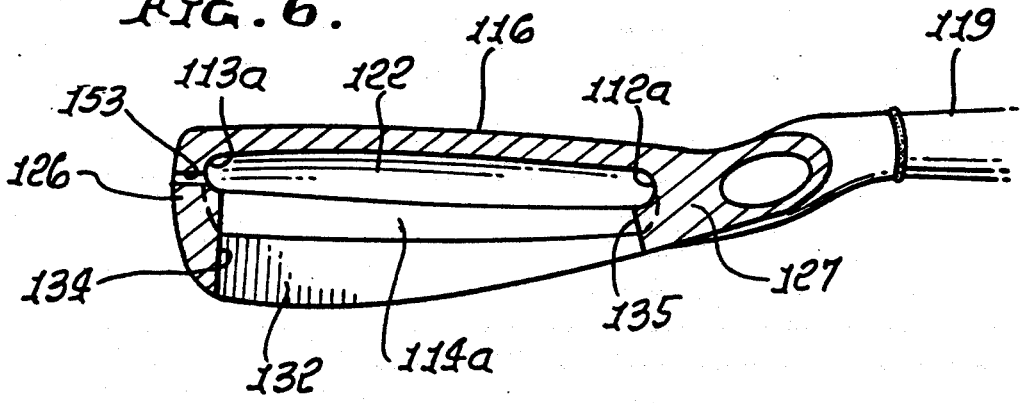
FIG. 6 is a horizontal section on lines 6—6 of FIG. 4.

FIGS. 4-6 show a corresponding construction of a #6 iron, having a more inclined front face, as shown. The corresponding numbered elements are the same as those in FIGS. 1-3, with each number preceded by a "1" i.e. providing a one hundred series of numbers.

Figure 7:
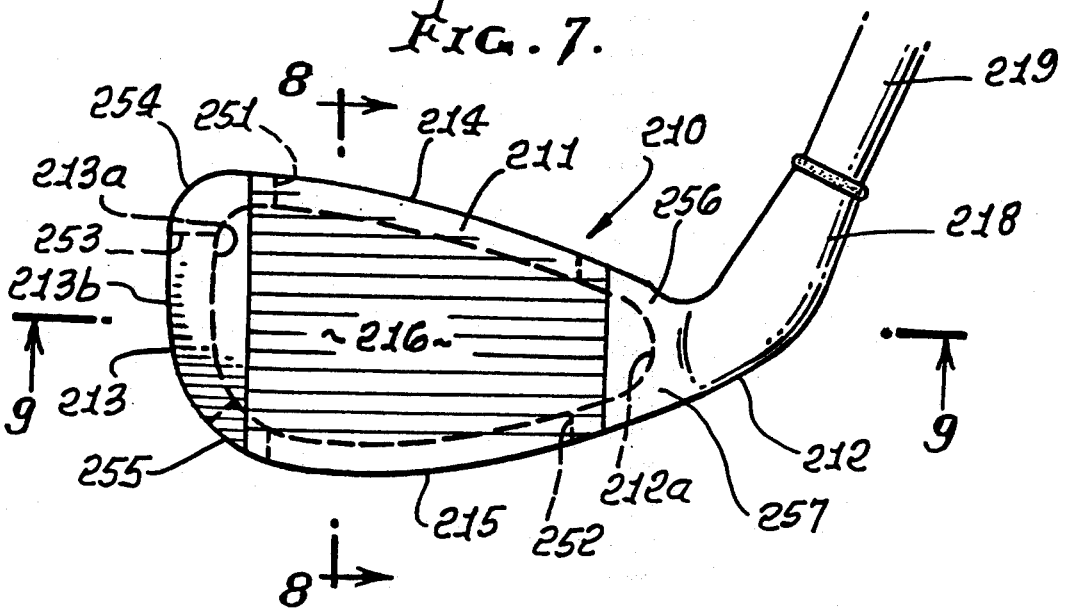
FIG. 7 is a view like FIG. 1 showing a #8 iron incorporating the invention.
Figure 8:
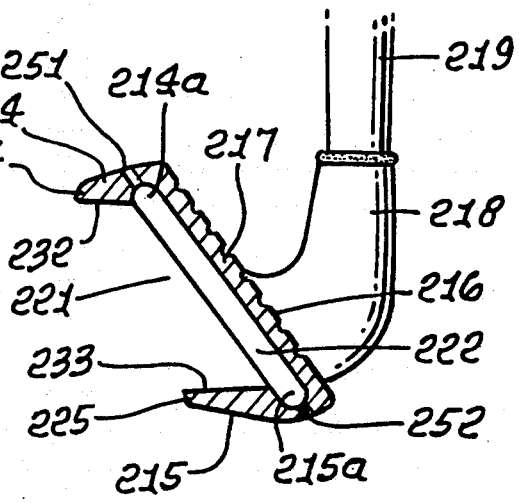
FIG. 8 is a vertical section taken on lines 8—8 of FIG. 7.
Figure 9:
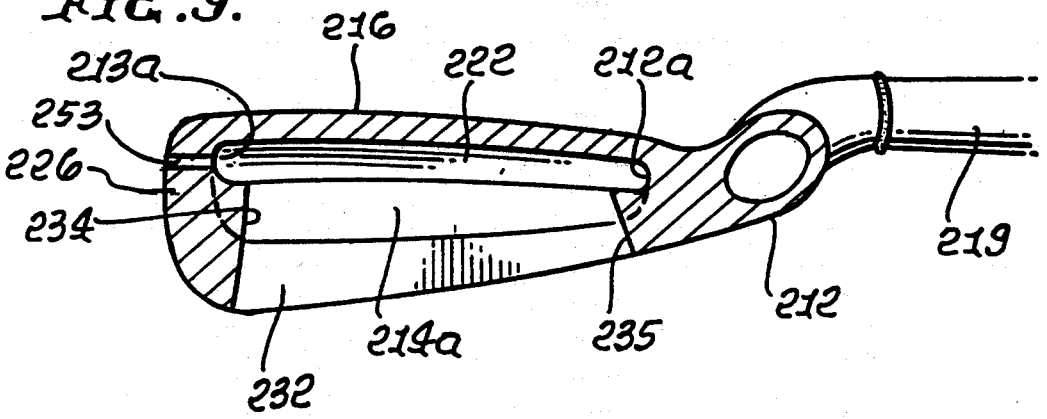
FIG. 9 is a horizontal section taken on lines 9—9 of FIG. 7.

FIGS. 7-9 correspond to FIGS. 1-3, but show a #8 iron with the two recesses in associated structure, as defined above. The corresponding elements have a "2"

preceding each number, whereby a two hundred series of elements is defined.

Figure 10:
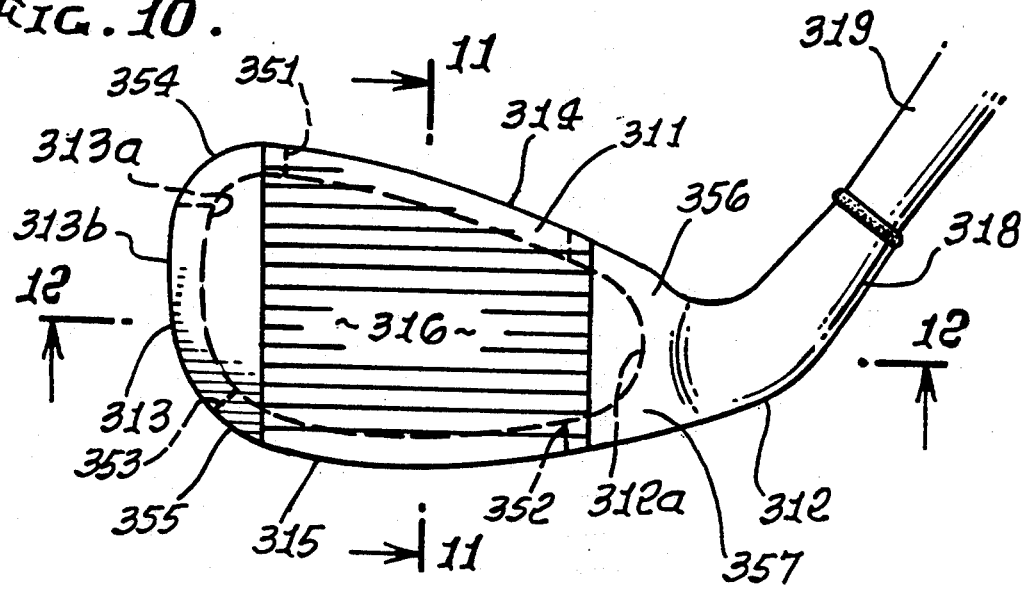
FIG. 10 is a view like FIG. 1 showing a pitching wedge incorporating the invention.
Figure 11:
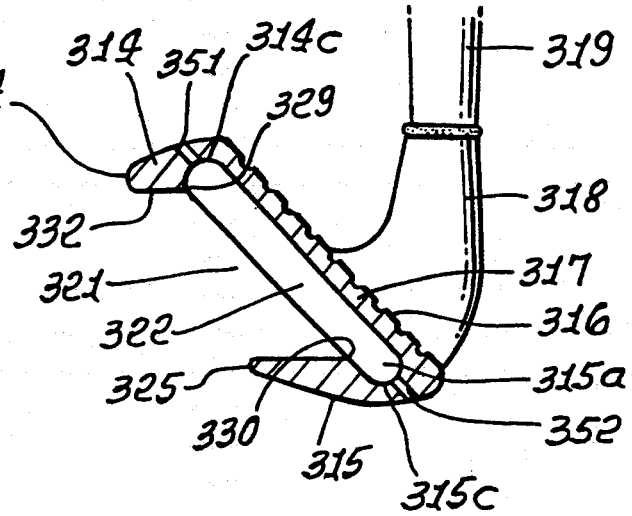
FIG. 11 is a section taken on lines 11—11 of FIG. 10.
Figure 12:
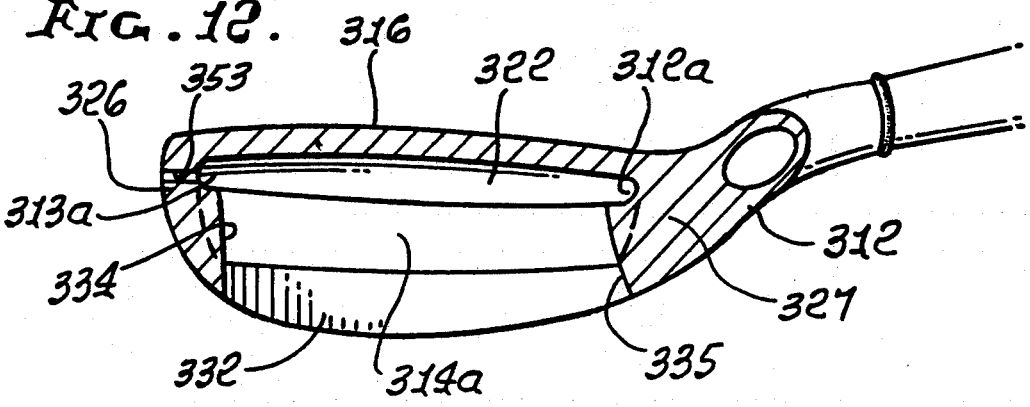
FIG. 12 is a section taken on lines 12—12 of FIG. 10.

FIGS. 10–12 correspond to FIGS. 1–3, but show a pitching wedge with the two recesses in associated structure, as defined above. The corresponding elements have a "3" preceding each number, whereby a three hundred series of elements is defined.

It will he understood that intermediate irons have the same construction, as in FIGS. 15–23, but with associated changing front face inclinations, as in a set of such irons. Accordingly, each iron of the set has the invention incorporated therein. FIGS. 15–23 are vertical sections taken at about the location of section 5—5 of FIG. 4.

Figure 15:
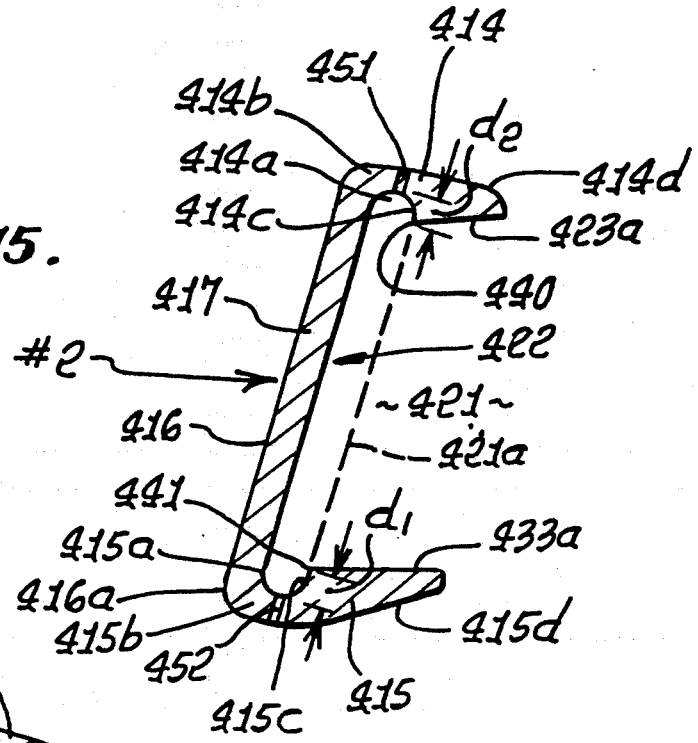

In FIG. 15, the main recess is shown at 421, and the undercut recess is indicated at 422, intersecting 421 at its forwardmost extent. See broken line 421*a*. The undercut recess extent into the top wall 414 is indicated at 414*a;* and the undercut recess into the bottom wall 415 is indicated at 415*a*. The depth of 415*a* is indicated at $d_1$, and the depth of the recess 414*a* is indicated at $d_2$, $d_1$ always being greater than $d_2$. This is also true for the irons of the set shown in FIGS. 16–23; and the minimum thickness of the narrowed region 414*b* is approximately the same as the minimum thickness of the bottom wall at 415*b*. For example, these thicknesses may be between 0.075 and 0.085 inches in typical clubs. The rearward slanting, or loft, of the undercut recess in the succession of heads of FIGS. 15–23 increases, as shown, in correspondence to the increasing rearward sloping of the head front walls, such a wall being shown at 417 in FIG. 15. The ball-striking face is indicated at 416. Depth $d_1$ extends below the upper level of front face downward curvature at 416*a*.

Also note in FIGS. 15–23 the sharp, edged corners, as in FIG. 15 at 440 and 441, these being defined by the intersection of the concave surface 414*c* and flat ledge 432*a;* and the concave surface 415*c* and the flat ledge 433*a*.

Referring again to the depth $d_1$ of the undercut 414*a* nearest the toe, that depth gradually diminishes upwardly from 415*a* along the undercut length closest to the toe end of the head until it equals the depth $d_2$ at the point where the undercut 414*a* meets the undercut 414*a* at the toe end of the club. The same gradient depth dimensioning exists at the undercut extent closest the heel. This is true for each of the heads shown in FIGS. 15–23.

Finally, the curvatures at 414*c* and 415*c* are circular, or approximately circular, as shown in each of the FIGS. 15–23; however, such curvatures may vary so long as a gradually narrowed and gradually expanded bottom and top wall thickness at 415*a* and 414*b*, respectively, is or are formed to facilitate a gradual pinch or "Bernoulli" effect, as respects achievement of delayed momentum wave transfer forwardly, as previously described. Note also upward and rearward inclination of bottom wall 415 surface at 415*d;* and downward and rearward inclination of top wall 414 surface at 414*d*.

See also the elongated slits 451 and 452, generally parallel to face 416, and intersecting recess 414 upper and lower extents 414*a* and 415*a*, as shown. A third such slit extends at the toe of the head and corresponds to slit 53 in FIGS. 1–3. Similar slits are shown in FIGS. 17–23, and in FIGS. 4–14.

All of these features, as described in connection with FIGS. 15–23, contribute to the unusual advantages of the invention, as referred to herein.

Figure 16:
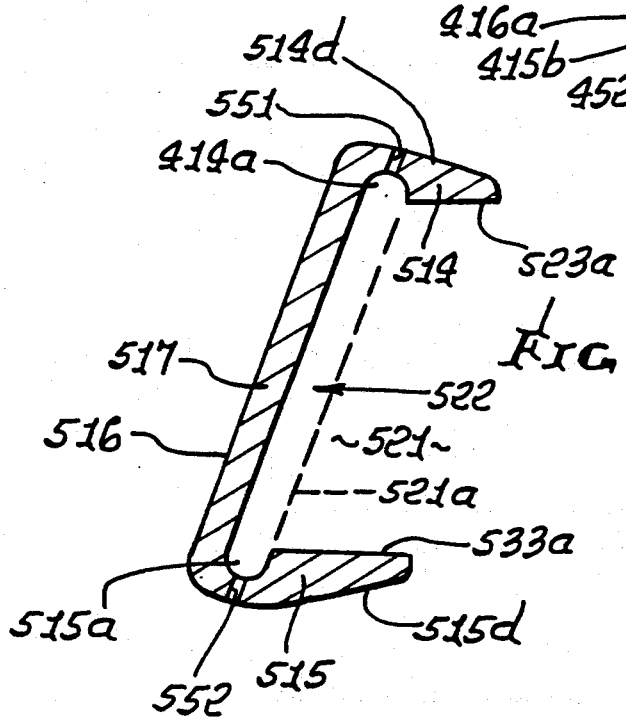
Figure 17:
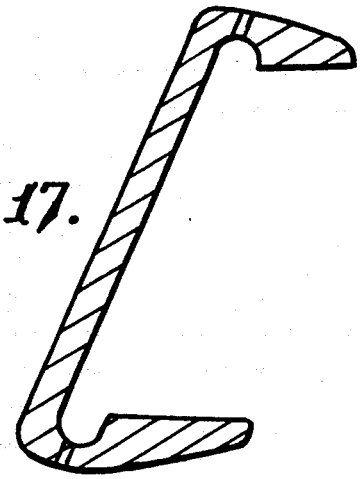

In FIG. 16, corresponding elements are the same as in FIG. 15, but commence with the number 5. See also the remaining views, FIGS. 17–23.

We claim:

1. A golf club head having a body defining a heel, toe, top wall, a bottom wall, and a front wall defining an upwardly and rearwardly inclined front face, and comprising a) said body defining a forwardly extending main recess located rearwardly of said front wall, b) said body also defining at least one rearward projection located vertically of said main recess and associated with one of said top and bottom walls, c) said body having at least one slit therein extending in said rearward projection, the slit intersecting an outer surface defined by the body, d) there being an undercut recess extending in said rearward projection proximate said front wall, said undercut recess intersecting said slit and said main recess, e) said rearward projection projecting directly rearwardly of said undercut recess.

2. The golf club head of claim 1 wherein there are at least two of said slits in said rearward projection.

3. The golf club head of claim 1 wherein said rearward projection extends rearwardly from lower extent of said front wall.

4. The golf club head of claim 1 wherein said rearward projection extends rearwardly from upper extent of said front wall.

5. The golf club head of claim 1 wherein said rearward projection extends rearwardly of upper extent of said front wall to form said top wall, there is an additional rearward projection extending rearwardly from lower extent of said front wall to form said bottom wall, there are at least two of said slits, said slits located in at least one of said rearward projections.

6. The golf club head of claim 2 wherein said undercut recess intersects multiple of said slits and said main recess.

7. The golf club head of claim 5 wherein said undercut recess intersects multiple of said slits and said main recess.

8. The golf club head of claim 1 wherein said slit extends generally parallel to said front face.

9. The golf club head of claim 1 wherein said slit extends generally normal to said front face.

10. The golf club head of claim 6 wherein said slits have one of the following configurations:

extend generally parallel to said front face extend generally normal to said front face.

11. The golf club head of claim 7 wherein said undercut recess extends outwardly from said main recess and adjacent said front wall toward at least two the following:

i) said top wall ii) said bottom wall iii) said toe iv) said heel.

12. The club head of claim 7 wherein said undercut recess extends outwardly from said main recess and adjacent said front wall toward at least three of the following:

i) said top wall ii) said bottom wall iii) said toe iv) said heel.

13. The golf club head of claim 7 wherein said undercut recess extends outwardly from said main recess toward all four of the following:

i) said top wall said bottom wall iii) said toe iv) said heel.

14. The golf club head of claim 13 wherein said undercut recess extends in a loop that is generally parallel to the inclined front face.

15. The golf club head of claim 13 in which certain of said slits extend toward lengthwise extents of said undercut recess.

16. The golf club head of claim 13 in which certain of said slits extend toward said main recess.

17. The golf club head of claim 13 in which said slits terminate endwise in spaced relation from head corners defined by merging of said top wall and toe, said bottom wall and toe, and said bottom wall and heel.

18. The golf club head of claim 1 wherein said body is metallic.

19. The golf club of claim 1 wherein said body consists of a metallic casting.

20. The golf club head of claim 1 wherein said body defines an iron golf club head.

21. The golf club head of claim 7 wherein one of said rearward projections, from the undercut recess, has substantially greater overall rearward dimension than vertical thickness dimension.

22. The golf club head of claim 5 wherein said undercut recess extends outwardly toward said top wall and toward said bottom wall, the depth of the undercut recess toward said top wall being lesser than the depth of said undercut recess toward said bottom wall.

23. The golf club head of claim 22 wherein said undercut recess toward said top wall has a substantially circular cross section adjacent said top wall, and said undercut recess toward said bottom wall has a substantially circular cross section adjacent said bottom wall.

24. Multiple golf club heads in a set, each head having a body defining a heel, toe, top wall, sole defining a bottom wall, and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least two of the following:

i) said top wall ii) said bottom wall iii) said toe iv) said heel, c) the undercut recesses in said bodies of the set having increasing rearward angularity in correspondence to increasing rearward angularity of the inclined front faces of the bodies of the set, d) and there being at least two slits in said body intersecting at least one of the following:

v) top wall vii) said bottom wall, e) said slits also intersecting said undercut recess.

25. The invention of claim 24 wherein in each of said bodies, the undercut recess projects toward the top wall and toward the bottom wall as defined, the undercut recess projecting toward the top wall having depth less than the undercut recess projecting toward the bottom wall.

* * * * *